United States Patent [19]

Jaekle

[11] 4,037,526

[45] July 26, 1977

[54] TRAIN TUNNEL VENTILATION METHOD AND APPARATUS

[75] Inventor: William M. Jaekle, Moraga, Calif.

[73] Assignee: Southern Pacific Transportation Company, San Francisco, Calif.

[21] Appl. No.: 665,425

[22] Filed: Mar. 10, 1976

[51] Int. Cl.[2] ..... E01G 7/02

[52] U.S. Cl. ..... 98/49; 49/264; 61/84; 104/138 R; 160/310

[58] Field of Search ..... 98/49; 61/84; 104/51, 104/52, 138 R; 49/262, 264; 160/310; 246/125, 126, 127

[56] References Cited

U.S. PATENT DOCUMENTS

| | | | |
|---|---|---|---|
| 585,881 | 7/1897 | Baker | 49/262 |
| 848,834 | 4/1907 | Lamb | 98/49 |
| 1,336,732 | 4/1920 | Davy | 104/138 R |
| 3,090,328 | 5/1963 | Berggren | 104/138 R |
| 3,583,465 | 6/1971 | Youngs et al. | 160/310 |
| 3,605,629 | 9/1971 | Edwards | 104/138 R |

*Primary Examiner*—Ronald C. Capossela
*Attorney, Agent, or Firm*—Lindenberg, Freilich

[57] ABSTRACT

A train tunnel is ventilated by closing an exit end of the tunnel as a train approaches the entrance end, so that during passage through the tunnel the train acts as a loose piston moving through a long closed cylinder, to cause a rapid airflow rearwardly around the train.

7 Claims, 7 Drawing Figures

26
64
34
80
68
CONTROL
66
62
66
67
76
58
70
52
36u
60
76m
76c
78
50
54
54
84
36L
36b
36
36R
14
10
56
56
74
82
86
72
28
12
12

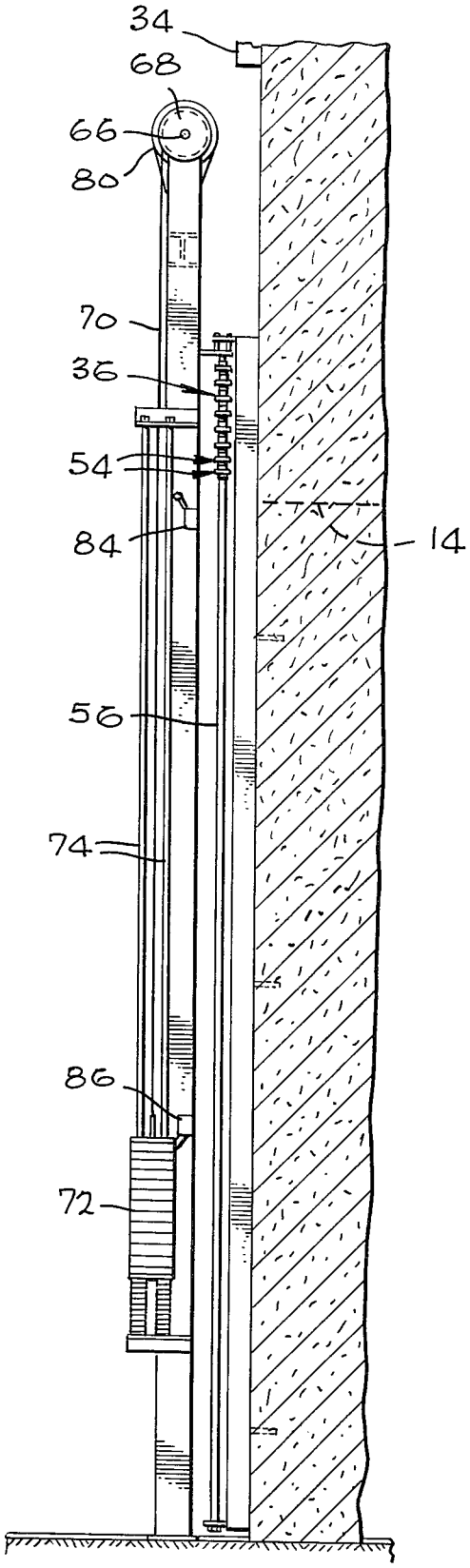
Fig. 9
Fig. 5
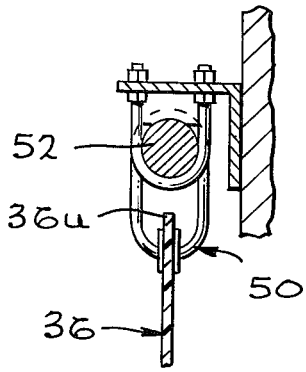
Fig. 6
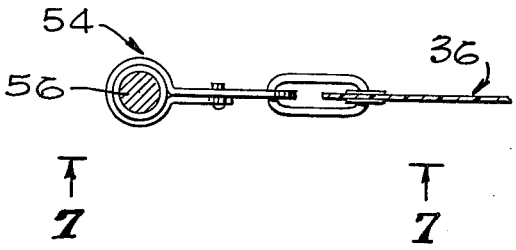
Fig. 7
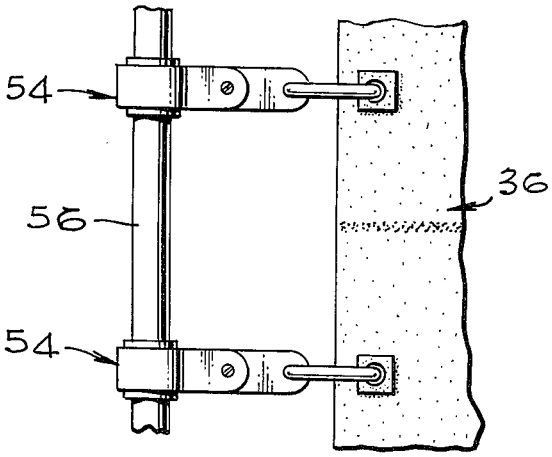

TRAIN TUNNEL VENTILATION METHOD AND APPARATUS

BACKGROUND OF THE INVENTION

When a locomotive of a train passes through a long tunnel, the exhaust of the locomotive engine pollutes the air in the tunnel by reducing the oxygen therein and increasing the concentration of carbon monoxide and other exhaust constituents. This pollution can be deleterious, especially where the train includes two or more locomotives, which is a common occurrence where long trains are utilized and/or some of the roadway extends at a steep incline. In such a case, the air intake of the second locomotive sucks in air containing a high proportion of the hot exhaust from the first locomotive, resulting in greatly diminished power output from the second locomotive and causing the second locomotive to overheat. The reduced output results in poor fuel efficiency, and this and the overheating results in the possibility of stalling of the train. Large fans can be utilized to ventilate the tunnel, but they have only a low effectiveness.

SUMMARY OF THE INVENTION

In accordance with one embodiment of the present invention, a method and apparatus are provided for ventilating a train tunnel, which are relatively simple and effective. The ventilation method includes closing an exit end of the tunnel before a train enters the entrance end of the tunnel or before the train has passed along a majority of the length of the tunnel after entering through the entrance the entrance end thereof. The train moving through the tunnel acts somewhat like a loose-fitting piston moving through a long, closed, cylinder. That is, as the piston-like train enters the closed tunnel, it displaces air, and the displaced air escapes by moving rearwardly in the tunnel space around the train. This causes a rearward air flow through the tunnel that helps to carry away and dilute pollution and heat from the exhaust of the locomotive. In the case of a train with two locomotives, the dilution of the exhaust from the first locomotive results in the second locomotive sucking in largely cool fresh air so that it can operate efficiently. Where the tunnel cross-section is only moderately larger than the cross-section of the locomotive, a rapid rearward air flow is created around the locomotive.

The novel features of the invention are set forth with particularity in the appended claims. The invention will best be understood from the following description when read in conjunction with the accompanying drawings.

BRIEF DESCRIPTION OF THE DRAWINGS

FIG. 4 is a view taken on the line 4—4 of FIG. 3;

FIG. 5 is a view taken on the line 5—5 of FIG. 3;

FIG. 6 is a view taken on the line 6—6 of FIG. 3; and

FIG. 7 is a view of a portion of the curtain guiding apparatus of FIG. 3.

DESCRIPTION OF THE PREFERRED EMBODIMENTS

Figure 1:
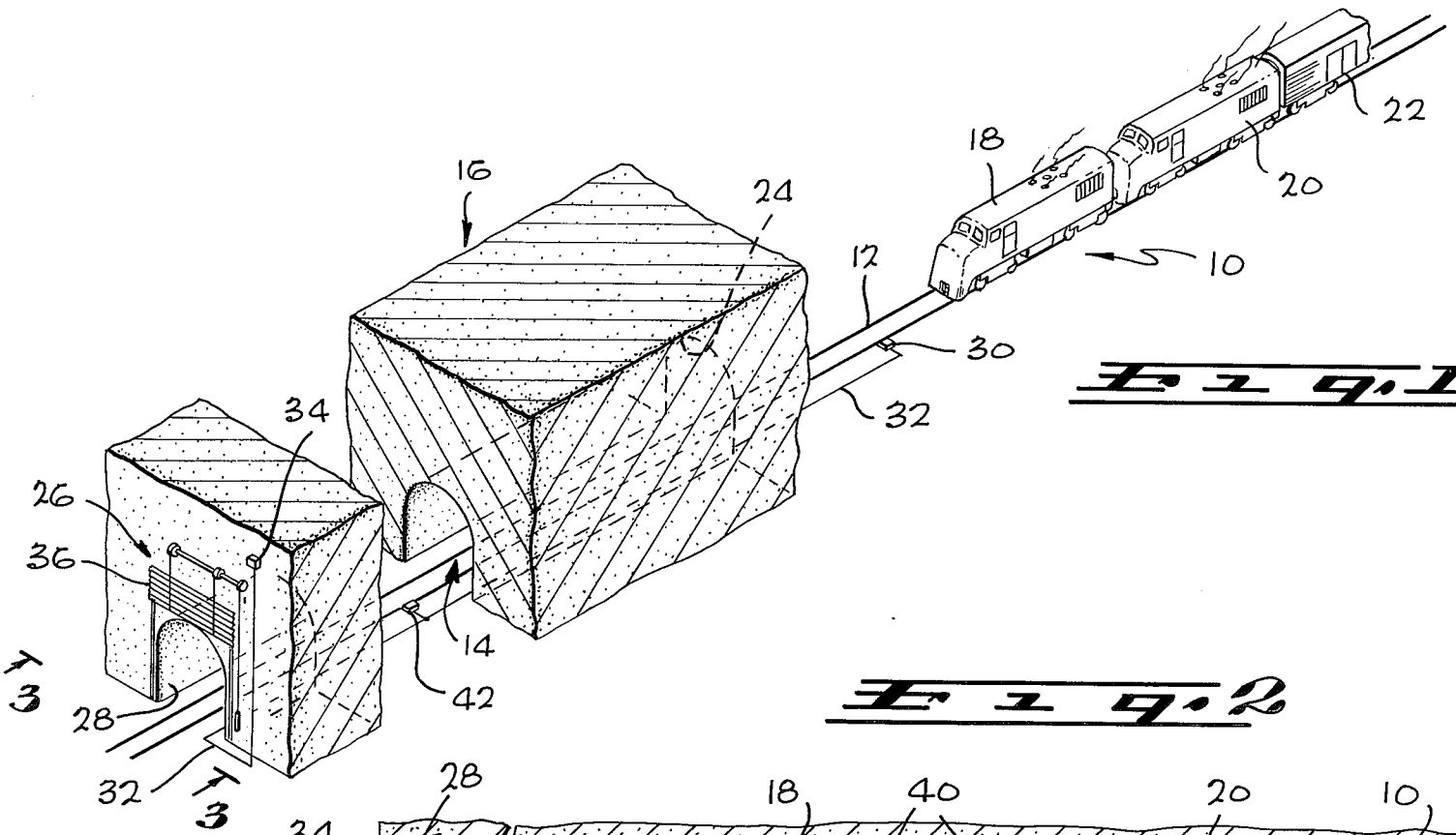
FIG. 1 is a perspective view of a train tunnel ventilation installation constructed in accordance with the present invention, showing a train approaching the entrance end of the tunnel and showing the cover at the exit end of the tunnel in an open position.

FIG. 1 illustrates a train 10 running uphill along a track 12 that leads through a long tunnel 14 formed in a mountain 16 or the like. The train 10 includes two diesel locomotives 18, 20 pulling a large number of cars 22 along the track. As the train approaches an entrance end 24 of the tunnel, a cover installation 26 is operated to close the exit end 28 of the tunnel. Specifically, as the train approaches the entrance end of the tunnel, it trips a track circuit or switch 30 wich is located far up-track from the exit end and also up-track from the entrance end of the tunnel, and which is coupled by a cable 32 to a control 34 of the cover installation. The control 34 can cause a cover 36 to be moved from an open position, to a closed position over the exit end of the tunnel so as to prevent the free flow of air out of the exit end of the tunnel.

Figure 2:
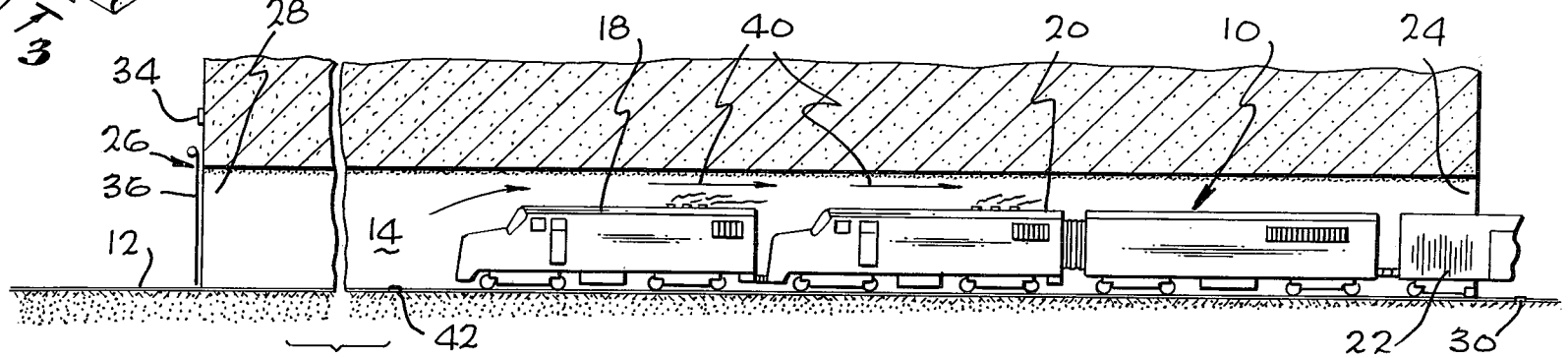
FIG. 2 is a sectional side view of the installation of FIG. 1, but showing the train within the tunnel and the tunnel cover in a closed configuration.

FIG. 2 illustrates the installation of FIG. 1 with the covers 36 in a closed condition over the exit end 28 of the tunnel, and with the train 10 positioned with its front end within the tunrel. As the train moves progressively deeper into the tunnel, it tends to compress the air in front of it. The pressure buildup is appreciable because the locomotive 18 fills a considerable portion of the corss-sectional area of the tunnel, such as on the order of 50%. If the exit end 28 of the tunnel were open to the free outflow of air therefrom, there would be a small buildup of air pressure in front of the train while considerable air moved forwardly out of the exit end of the tunnel. This would result in a relatively slow movement of air rearwardly past the train relative to the train's motion. In such a case, the exhaust from the diesel engine of the first locomotive 18 would tend to accumulate around the front portion of the train and be sucked in by the air intake of the second locomotive 20. As a result, the second locomotive would run at a greatly reduced efficiency. This not only increases fuel comsumption, but reduces horsepower output which can result in considerable slowing or even stalling of the train where the train is very long and the track 12 extends at a steep incline.

With the cover 36 in a closed configuration over the exit end 28 of the tunnel, forward motion of the train 10 in the tunnel results in a considereable air pressure buildup in front of the train. This results in a considerable rearward air flow around the train, as indicated by the arrows 40. This rapid rearward air flow relative to the train tends to carry the exhaust from the first locomotive 18 rapidly past the second locomotive and to highly dilute it with fresh cool air. As a result, the engine of the second locomotive 20 runs at close to normal efficiency. The rearward flow of air also serves to carry the exhaust rearwardly out through the entrance end 24 of the tunnel so that the concentration of pollutants in the tunnel is reduced after the train has passed through it.

When the train 10 approaches the exit end 28 of the tunnel, it trips a second switch 42 located up-track from the cover 36. The switch is coupled to the control 34 which then causes the cover 36 to be raised to an open position just prior to the arrival of the train thereat. By the time the front end of the train reaches the exit end of the tunnel, the cover is completely opened so that the train can move rapidly out of the tunnel. The cover 36 remains open until a next train approaches the tunnel. It is preferable to begin closing the exit end of the tunnel before the train enters the tunnel, but considerable benefit can be obtained even if the closing occurs after the train has entered but before it passes through a majority of the tunnel length.

Figure 3:
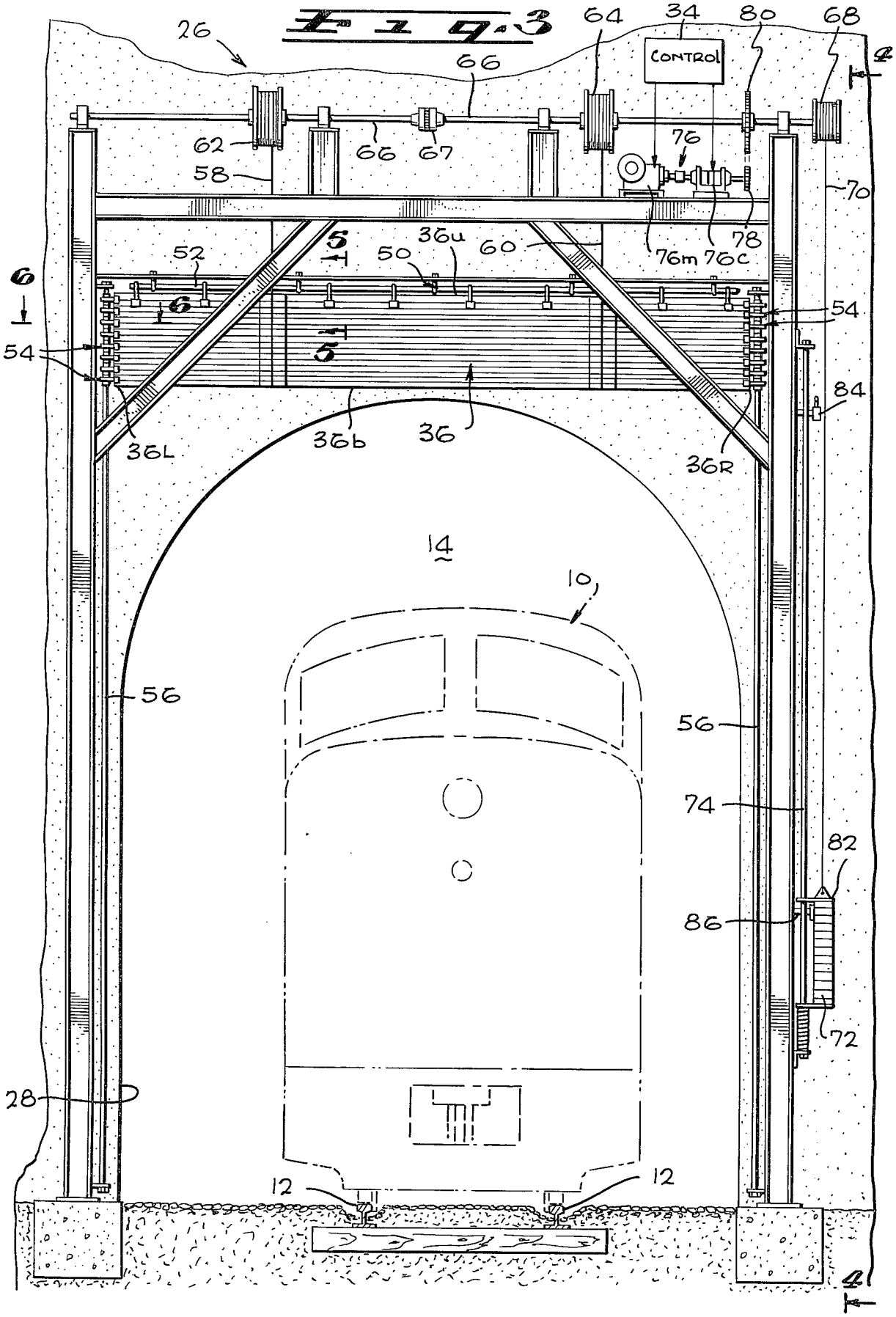
FIG. 3 is a view taken on the line 3—3 of FIG. 1.

FIGS. 3 and 4 illustrate some of the details of the cover installation 26 which can cover the exit end 28 of the tunnel. The cover 36 is formed of a duarable sheet of flexible and relatively low weight material such as Hypalon-Neoprene. The upper edge 36*u* of the sheet is supported by numerous hooks 50 on a transverse rod 52. The left and right edges 36L, 36R of the cover 36 are coupled by numerous rings 54 to a pair of vertical guide rods 56 that guide the cover in up and down movement. The cover is raised and held in its upward position by a pair of ropes 58, 60 that extend from the lower end 36*b* of the cover to a pair of curtain pulleys 62, 64 that are fixed to a shaft 66 that has two portions coupled by a flexible coupling 67. A counterweight pulley 68 which is also fixed to the shaft 66, is coupled by a wire 70 to a counterweight 72. The counterweight 72, which is guided in vertical movement by a pair of guide rods 74, tends to rotate the shaft 66 in a direction to pull up the cover 36 to an open position.

A gear head motor and clutch assembly 76 has an output shaft 78 connected by a chain to a sprocket 80 which is fixed to the shaft 66. When the motor assembly 76 is energized in a forward direction, it turns the shaft 66 in a direction to raise the counterweight 72 and to allow the cover 36 to unfold and drop down under its own weight. The motor assembly is energized until a projection 82 on the weight trips an up limit switch 84, at which time the cover will lie in its fully closed position wherein it substantially completely covers the exit end of the tunnel.

When the train 10 approaches the exit end of the tunnel and trips switch 42, the motor assembly 76 is energized in a reverse direction to turn the shaft 66 in a direction to raise the cover 36 while lowering the weight 72. This continues until the projection 82 engages a lower limit switch 86 which ceases energizing of the motor assembly. The weight 72 is preferably made heavy enough that, in absence of the motor assembly 76, the weight will move the cover 36 to its upward position. The motor assembly includes a clutch and brake portion 76*c* which must be electrically energized to couple a motor portion 76*m* to the shaft 66. Thus, if the motor assembly 76 is de-energized so that the clutch portion 76*c* thereof remains disengaged, then the cover will automatically be moved up to its open position by the counterweight. The motor assembly 76, as well as the limit switches 84, 86 and the train sensing switches 30, 42, are all coupled to the control 34. The control 34 is a relatively simple circuit for operating the motor assembly 76 in forward and reverse directions in response to operation of the train-sensing switches 30, 42.

An important factor in obtaining high ventilation effectiveness, is the time required to move the cover away from the exit end of the tunnel as the train approaches it. The use of a flexible curtain which folds up during movement up and away from the tunnel end, allows for a relatively rapid movement. This is because the average distance over which the curtaincover moves, is only about half the height of the tunnel; that is, the bottom 36*b* of the cover moves a distance equal to the height of the tunnel, but the top 36*u* of the cover does not move at all. During upward movement of the cover, there is only low friction between the rings 54 and the guide rods 56, because the rings merely guide the edges of the curtain cover rather than serving as bearings that slideably support the weight of the cover. The plastic cover is relatively light weight, as compared to a steel cover, but serves effectively because the cover material is subjected to tension forces during use. The folding cover provides a compact installation, which uses a motor and other driving mechanisms, as well as support, and guiding devices, which are all of only moderate size, to provide a relatively low cost installation.

Thus, the invention provides a relatively simple and effective ventilation method and apparatus for use with a tunnel to ventilate it as a vehicle passes therethrough. This is accomplished by utilizing a covering means near the exit end of the tunnel, which is maintained closed during a portion of travel of a train through the tunnel, and preferably during movement of the train along a majority of the length of the tunnel. While a curtain is described as used in the cover, a variety of other cover structures can also be used. However, the folding curtain provides for rapid cover movement to aid in its effective use. The present ventilation method is especially effective where a train 10 is involved which occupies at least on the order of 50% of the cross-sectional area of the tunnel 14, inasmuch as this results in rapid rearward air flow around the train. It may be noted that it is not necessary for the cover 36 to completely seal the tunnel, but only to prevent the free flow of air therefrom so as to cause a greater buildup of air pressure in front of the train then would otherwise occur in the absence of a cover. In fact, an open area can be purposely provided so that there is not an excessive pressure buildup as the train comes closer to the exit end of the tunnel. The power required to move air through the tunnel is obtained by utilizing a small portion of the power developed by a normally powerful locomotive, and therefore ventilation is accomplished without requiring separate high capacity fans or other ventilating machinery at the tunnel location. The apparatus for opening and closing the cover utilizes only a small motor.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A method for ventilating a train tunnel that has entrance and exit ends, comprising:

closing said tunnel against the free flow of air from the exit end thereof and maintaining said tunnel closed, while driving said train through said tunnel toward the exit end thereof; and opening the exit end of said tunnel before said train reaches the exit end of said tunnel.

2. The method described in claim 1 wherein:

said step of closing includes sensing the presence of the front end of said train at a first location uptrack from the entrance end of the tunnel, and lowering a cover over said exit end of said tunnel when said sensing is made; and said step of opening includes sensing the presence of the front end of said train at a second location in said tunnel which is uptrack from said exit end thereof, and raising the cover over said exit end when said sensing is made at said second location.

3. The method described in claim 1 wherein:

said step of closing comprises lowering the lower end of a folded curtain over the exit end of the tunnel while guiding the opposite side of the curtain; and said step of opening comprises raising the lower end of the curtain while refolding the curtain into a folded configuration lying immediately above the tunnel.

4. In combination with a tunnel structure which includes walls forming a tunnel with first and second end portions, and a train track extending through said tunnel, ventilation means comprising:

cover means including a cover and also including cover moving means for moving said cover between closed and open positions with respect to said second end portion of said tunnel;

first train sensing means for sensing a train on said track at a first location at a first uptrack distance from said cover means;

first control means coupled to said train sensing means and to said cover moving means, for moving said cover means to its closed position upon te sensing of a train at said first location by said first train sensing means;

second train sensing means for sensing a train on said track at a second location which lies at a second uptrack distance from said cover means; and second control means coupled to said train sensing means and to said cover moving means, for moving said cover means to its open position upon the sensing of a train at said second location by said second train sensing means, said first location being more distant from said cover means than said second location.

5. The combination described in claim 4 wherein:

said moving means is electrically energizable, and is constructed to move said cover means to an open position in the absence of the availability of electrical energization.

6. The combination described in claim 4 including:

a train having a cross-sectional area on the order or magnitude of 50% of the cross-sectional area of the tunnel.

7. The combination described in claim 4 wherein:

said cover means comprises a foldable curtain, and said cover moving means is constructed to move said curtain from a folded configuration at a position at the top of the second end portion of the tunnel, to an unfolded position over the second end portion of the tunnel.

* * * * *